United States Patent [19]

Hess et al.

[11] Patent Number: 4,574,976

[45] Date of Patent: Mar. 11, 1986

[54] FOLDABLE TANK DRAIN STOP COVER

[76] Inventors: Wayne R. Hess, R.D. #2, A470; James L. Raffenberger, R.D. #1, Box 339, both of Dallastown, Pa. 17313

[21] Appl. No.: 684,339

[22] Filed: Dec. 20, 1984

[51] Int. Cl.[4] ..... F16L 55/10

[52] U.S. Cl. ..... 220/315; 138/89

[58] Field of Search ..... 4/585, 586; 128/DIG. 15; 138/99, 89; 141/10; 220/200, 350, 315, 359, 403; 386/66

[56] References Cited

U.S. PATENT DOCUMENTS

| | | | |
|---|---|---|---|
| 1,341,507 | 5/1920 | Jacobsson | 220/403 |
| 2,954,891 | 10/1960 | Imber | 220/403 |
| 3,951,284 | 4/1976 | Fell et al. | 141/10 X |
| 4,301,791 | 11/1981 | Franco, III | 128/DIG. 15 |
| 4,461,402 | 7/1984 | Fell et al. | 220/403 X |

FOREIGN PATENT DOCUMENTS

| | | | |
|---|---|---|---|
| 959263 | 2/1957 | Fed. Rep. of Germany | 220/403 |
| 729421 | 7/1932 | France | 4/585 |

*Primary Examiner*—Stephen Marcus
*Assistant Examiner*—Mark Thronson

[57] ABSTRACT

This tank drain cover is designed to cover and uncover the drain opening in a foldable liquid storage tank, with little loss of liquid when the liquid in one tank is transferred to a similar tank. Primarily, it consists of a flexible and water-proof flap, that will fasten over the drain opening in the tank, and velcro fastener strips or other fastener means are secured to the flap and around the drain opening through the tank, to effect the holding of the flap over the opening.

6 Claims, 5 Drawing Figures

FOLDABLE TANK DRAIN STOP COVER

This invention relates to devices for foldable tanks, and more specifically, to a foldable drain stop cover.

The principal object of this invention is to provide a foldable tank drain stop cover, which will be of such design as to enable one to connect two or more foldable tanks together, for the purpose of passing a liquid from one tank to the other, and the liquid is passed through a dump drain hose.

Another object of this invention is to provide a foldable tank drain stop cover, which will be of such design as to enable one to connect the tanks together with a minimum of liquid loss in either of the tanks, even if all are filled with a liquid.

A further object of this invention is to provide a foldable tank drain stop cover, which will be of a liquid-proof flexible material, that will be attached to the inside of the tank, where the dump drain is connected.

A still further object of this invention is to provide a foldable tank drain stop cover, which will include velcro fastener means or other fastener means for keeping the stop cover in place, and the fastener means will keep the cover in place when the tank is folded or unfolded. The stop cover will also prevent the liquid from running out of such tanks.

Other objects are to provide a foldable tank drain stop cover, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 4, 5:
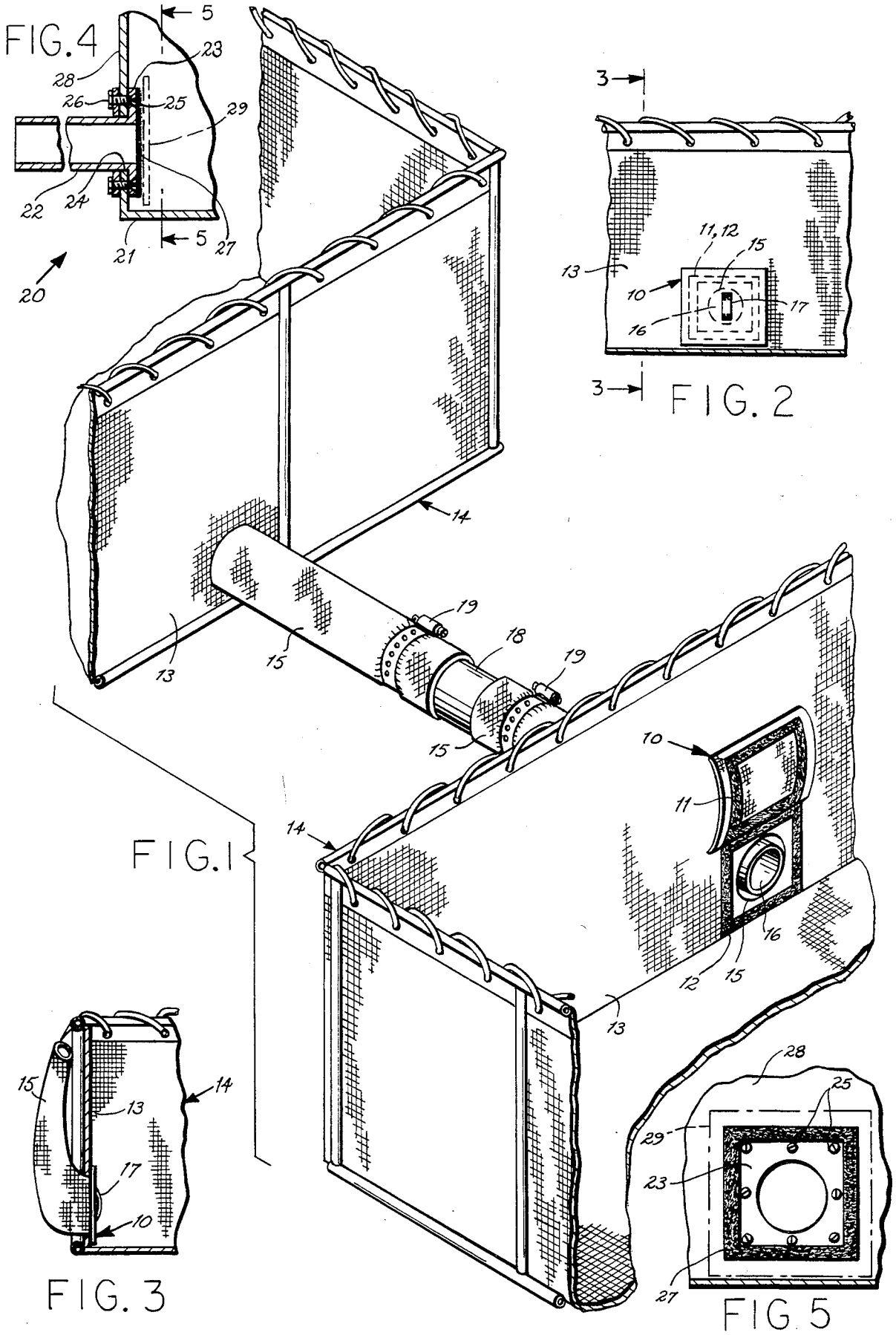
FIG. 1 is a fragmentary perspective view of two tanks, showing the present invention installed.
FIG. 2 is a fragmentary elevational view of one tank interior, showing the invention in closed condition.
FIG. 3 is a cross-sectional view, taken along the line 3—3 of FIG. 2.
FIG. 4 is a fragmentary cross-sectional view of a modified form of the invention.
FIG. 5 is a cross-sectional view, taken along the line 5—5 of FIG. 4.

Accordingly, a stop cover 10, of square configuration, in this instance, is made of a suitable liquid-proof material, and includes a similarly-shaped velcro fastener strip 11, which is slightly smaller in size than cover 10. This square strip 11 is suitably fixedly secured to one face of cover 10, and a mating strip 12, of similar size and shape, is suitably fixedly secured to a wall 13 of a folding tank 14, which serves to hold liquid (not shown). The mating strip 12 is positioned around the flexible dump drain tube 15, which is normally secured in wall 13, and the cover or flap 10 covers the opening 16 of tube 15, when it is desired to prevent the fluid from flowing out of the tank 14. A handle 17 is also fixedly secured, in a suitable manner, to the outside face of stop cover 10, for lifting it to enable fluid to pass out of tank 14. When two tanks 14, with covers 10, are to be used to transfer the liquid from one to the other, a pipe 18 is employed, by being inserted into the two tubes or hoses 15 thereof, and pipe 18 is secured in place by means of adjustable clamps 19.

In use, the cover 10 is normally in place, and held fast by the velcro fastener strips 11 and 12, which prevents any escape of the fluid received in one of the tanks 14. When the user wishes to connect another tank 14 to the liquid-filled one, he slides the pipe 18 into one tube 15, and also into the similar tube 15 of the other tank, and clamps them into place by tightening the clamps 19. The user then reaches inside the tank 14 filled with liquid, and, by the handle 17, he removes the flexible water-proof cover 10 from the opening 16. When cover 10 is thus removed, the liquid drains out and into the other tank 14, and it shall be recognized, that when no other tank 14 is present, cover 10 is removed when it is wished to just drain that tank 14. Upon completion of the operation, the cover 10 is then replaced, and it shall also be noted, that this tank 14 and cover 10 combination are adaptable for employment in the fire fighting service, etc. When the tanks 14 are folded, the covers 10 are always to be fastened in place by the velcro fastener strip means, so as to prevent loss thereof.

Looking now at FIGS. 4 and 5 of the drawing, a modified form of stop cover and tank combination 20 is shown to include a storage tank 21, having a pipe 22 with a flange 23 on one end. Pipe 22 is received in opening 24 through tank 21, and is fastened therein, by bolt fasteners 25 and nut fasteners 26. A velcro strip 27 is suitably fixedly secured to wall 28, and a mating velcro strip 27 is also fixedly secured to a face of a water-proof cover 29, which is similar to cover 10, heretofore described.

In use, the modified combination 20 functions in the same manner as cover 10, with the exception, that the pipe 22, the cover 29, and the velcro fastener strips 27 may be made in kit form, for employment in storage tanks not having a drain, or a storage tank needing a plurality of drains.

While various changes may be made in the detail construction, it is understood that such changes will be within the spirit and scope of the present invention, as is defined by the appended claims.

What we now claim is:

1. A combination comprised of a foldable tank designed to receive and temporarily retain a liquid medium, a discharge drain opening mounted within a lower side wall position of said foldable tank, a cooperative affixment means supportably assembled upon and peripherally encompassing said discharge drain opening, a flexible dump drain tube in communication with said discharge drain opening, and a foldable tank drain stop cover adapted to sealably occlude and releasably clear said discharge opening;

said foldable tank drain stop cover comprising a planar flexible flap of a geometrical configuration adapted to be received in said tank, said foldable tank drain stop cover further comprising a cooperative affixment means assembled upon and peripherally encompassing one planar side surface of said planar flexible flap for releasable attachment thereof to said cooperative affixment means supportably assembled upon said discharge drain opening, said foldable tank drain stop cover further comprising a handle means connectably assembled upon said planar flexible flap on the opposite planar side thereof to thereby facilitate placement and selective removal of said foldable tank drain stop cover in accomplishing occlusive covering and releasable opening of said discharge drain opening in effecting transfer of said liquid medium from said foldable tank to another foldable tank by an insertable interconnecting conduit means communicably joining the respective flexible dump drain tubes thereof.

2. The combination as set forth in claim 7, wherein said complementary cooperative affixment means is a mating velcro strip.

3. The combination as set forth in claim 2, wherein said foldable tank drain stop cover is a liquid-proof material.

4. The combination as set forth in claim 1, wherein said cooperative affixment means is a velcro fastener strip.

5. The combination as set forth in claim 1, wherein said geometrical configuration is a square shape.

6. The combination as set forth in claim 1, wherein said handle means is an elongated member.

* * * * *